United States Patent [19]

Brueton et al.

[11] Patent Number: 5,006,827

[45] Date of Patent: Apr. 9, 1991

[54] THERMOSTAT HAVING A MOVABLE BACKSTOP

[75] Inventors: Stephen J. Brueton, Stouffville; Adriana V. Serbanescu, Scarborough, both of Canada

[73] Assignee: Honeywell, Inc. - Honeywell Limitée, North York, Canada

[21] Appl. No.: 510,928

[22] Filed: Apr. 19, 1990

[51] Int. Cl.[5] ..... H01H 37/12; H01H 37/52

[52] U.S. Cl. ..... 337/361; 337/353

[58] Field of Search ..... 337/353, 351, 350, 349, 337/305, 360, 361, 368, 349, 374

[56] References Cited

U.S. PATENT DOCUMENTS

| | | | |
|---|---|---|---|
| 3,210,503 | 10/1965 | Hummel | 337/374 |
| 3,943,479 | 3/1976 | Turner | 337/360 |
| 3,949,344 | 4/1976 | Hancock et al. | 337/361 |

*Primary Examiner*—Harold Broome

*Attorney, Agent, or Firm*—Robert B. Leonard

[57] ABSTRACT

A thermostat is disclosed which has a moveable backstop in order to fulfill a requirement in many countries that a 3 millimeter contact gap be provided for the thermostat to qualify as an electrical disconnect. The thermostat is comprised of a setting wheel having a ramp formed thereon, a lever, a plunger and a backstop slidably connected to the frame of the thermostat. The lever contacts the ramp on the setting wheel and is moved by rotation of the setting wheel. One end of the plunger is in contact with the lever, the other end being in contact with the backstop. When movement of the setting wheel causes movement of the lever, the plunger is moved in an axial direction thereof, thus causing movement of the backstop. The ramp is positioned on the setting wheel such that the backstop is moved when the setting wheel is turned to an off position.

6 Claims, 2 Drawing Sheets

THERMOSTAT HAVING A MOVABLE BACKSTOP

BACKGROUND OF THE INVENTION

The present invention is related to the field of temperature control devices. More specifically, the invention is a thermostat with a variable length contact gap.

Thermostats were well known devices which were used in controlling the temperature of an enclosed area. One particularly well known type of thermostat included a deformable element which deformed upon a change in temperature, such as a bimetal element. Attached to the deformable element was a movable contact, which moved when the deformable element deformed. A fixed contact was positioned near the movable contact such that when the deformable element deformed due to a decrease (or increase) in temperature, the movable contact and the fixed contact were put into contact and in the process completed an electrical circuit. By completing the circuit, a plant, which can be either a heater or cooler or both, could be actuated to raise or lower the temperature of the enclosed area.

As the temperature of the space controlled by the thermostat rose (or dropped), the deformable element would recover from a deformed state to a normal state. This would cause the contacts to be open. The change in temperature required to cause the contacts to cycle from closed to open, or open to closed is called the thermal differential. In order to maintain a comfortable temperature in the controlled space, the thermal differential must be kept small. This in turn dictates that the mechanical distance from contact open to contact closed, be kept small.

To keep the mechanical distance small, a backstop was installed into the thermostat. The backstop is positioned such that the movable contact moves between the fixed contact and the backstop and is placed in close proximity to the fixed contact.

A problem exists in that there is a requirement in European countries that there be a three millimeter gap between the movable contact and the fixed contact for the device to be acceptable as an electrical disconnect. Yet, such a large gap at all times would require that a large temperature differential be overcome before the fixed and movable contacts touched.

Thus, it is an object of the present invention to provide a thermostat with low thermal differential when cycling. It is a further object of the present invention to provide a thermostat which is acceptable as an electrical disconnect when the thermostat is off.

SUMMARY OF THE INVENTION

The present invention accomplishes these objects by providing a thermostat with a movable backstop. The thermostat is comprised of a frame, a setting wheel with a ramp thereon, a lever, a plunger, a fixed contact and a movable backstop. The ramp is adapted to move the movable backstop as the setting wheel is adjusted to the off position. When the setting wheel is adjusted to an off position, the lever is moved, thus causing a depression of the plunger. The plunger then moves the backstop so that the gap between the fixed contact and the backstop is set to at a minimum of three millimeters.

DETAILED DESCRIPTION OF THE DRAWINGS

Figure 1:
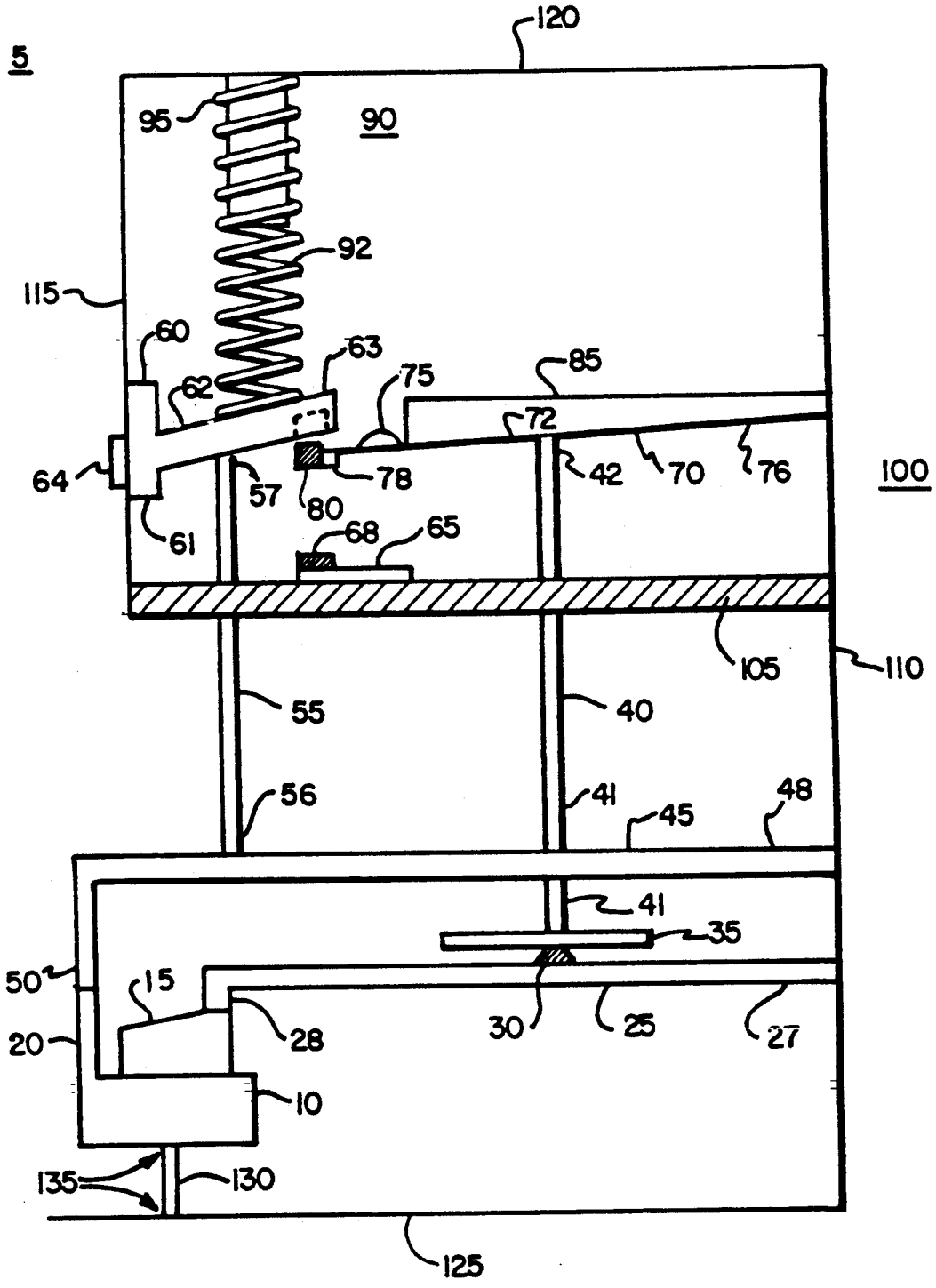
FIG. 1 is a side view of the thermostat of the present invention.

Referring now to FIG. 1, thereshown is a preferred embodiment of the thermostat 5 of the present invention. Setting wheel 10 is attached to flange 125 of frame 100 at post 130. Setting wheel 10 is comprised of first ramp 20 and second ramp 15 and can be rotated in either direction indicated by arrow 35.

First lever 45 is attached to frame 100 through a first end 48, at sidewall 110 and has a second end 50 which serves as a ramp follower. Second end 50 is contacted by the first ramp 20 only when the setting wheel is substantially in an off position.

Second lever 25 is also attached to frame 100 through a first end 27 at sidewall 110 and has a second end 28 which serves as a ramp follower. The second end 28 is in continuous contact with the second ramp 15 of setting wheel 10. Second lever 25 also includes a protrusion 30 which can be used to position the deformable element.

For this embodiment, deformable element 35 is interposed between the first and second levers 25, 45. Deformable element 35 expands upon an increase in temperature, and contracts upon a decrease in temperature. It is important to note that it is not necessary for the deformable element 35 to be positioned between first and second levers 25, 45, but that such an arrangement is preferred to save space.

First plunger 55 has fifth and sixth ends 56, 57 and is journaled through flange 105 of frame 100. First end 56 is in contact with the first lever and the second end is in contact with backstop 60.

Second plunger 40 has first and second ends 41, 42, and is journaled through flange 105 and passes through first lever 45. First end 41 contacts deformable element 35, and second end 42 contacts movable contact 70.

Backstop 60 is formed of two major parts. First flange 61 is slidably attached to sidewall 115 of frame 100. Sidewall 115 may have a slot (not shown) formed therein in which a tab 64 may ride. Second flange 62 is attached substantially perpendicularly to first flange 61. In addition, second flange 62 may have a recess 63 formed therein.

To move the backstop to create a smaller contact gap during the operation of the thermostat, a backstop return means 90 can be included. The backstop return means 90 comprises a spring 92 and a post 95. Post 95 is attached to sidewall 120 of frame 100. Spring 92 is placed over post 95 and in contact with the backstop. The spring 92 should be chosen so that when the backstop is at a maximum distance from the fixed contact 65, the spring is under compression.

Fixed contact 65 is attached to flange 105 of frame 100 and can include a metal mass 68. Metallic mass 68 can be carefully formed so as to accurately set up the contact gap between the backstop and the fixed contact.

For this embodiment, movable contact 70 is comprised, of a blade 72 and a ,mass, 80. Blade 72 has first and second ends 76, 78. First end 76 is attached to sidewall 110, while tenth end 78 is free to move between backstop 60 and fixed contact 65. Second end 78 may include mass 80. It may also be desirable to make blade 72 into a snap acting mechanism, as shown in FIG. 1 by adding a tension member 75, and a tension flange 85. Tension flange 85 engages one end of and compresses tension member 75.

The operation of the thermostat will now be described. Setting wheel 10, through the use of second ramp 15 and second lever 25, is used to control the temperature at which the fixed and movable contacts 65, to make contact. Second lever 25 moves to follow second ramp 15 as setting wheel 10 is turned. In FIG. 1, ramp follower 28 is shown contacting second ramp 15 at the ramps highest position. This moves deformable element 35 which in turn causes second plunger 40 to deflect the blade 72 of movable contact 70 away from the fixed contact 65.

When the thermostat is turned on, and consequently the ramp follower 28 is not as high as depicted in FIG. 1, ramp follower 28 moves closer to flange 125, thus allowing the deformable element 35 to move closer to flange 125. At this point, movement of second plunger 40 depends upon both the position of second lever 25 and the amount of expansion of deformable element 35. As the temperature in the vicinity of the deformable element rises, the deformable element expands, causing second plunger 40 to move axially toward the movable contact 70. When the force exerted by second plunger 40 is great enough to overcome the spring force exerted by the blade 72 of movable contact 70, the mass 80 moves so that it is no longer in contact with the fixed contact 65. When the temperature in the vicinity of the deformable element drops once again, the deformable element contracts, thus reducing the force exerted on the blade of the movable contact. The mass 80 then snaps back into contact with fixed contact 65.

Figure 2A:
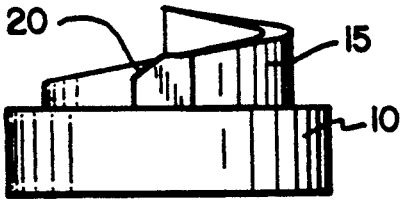
FIG. 2A is a front view of the setting wheel used in the present invention.
Figure 2B:
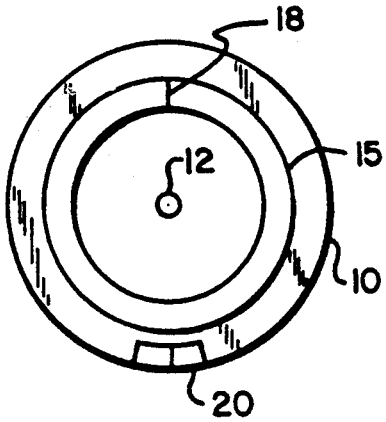
FIG. 2B is a top view of the setting wheel.

The movement of the backstop will now be described. Setting wheel 10 includes a first ramp 20 which can be better viewed with reference to FIGS. 2A and B. Thereshown is the setting wheel 10, first ramp 20 and second ramp 15. In this embodiment, first ramp 20 and second ramp 15 are separate ramps, the first ramp being formed at a greater distance from the center of the setting wheel 12 than the second ramp. Another difference is that the first ramp 20 describes an arc of a circle, while second ramp 15 describes a complete circle. As a result, first lever 45, which follows first ramp 20, is only contacted by ramp 20 for a portion of the setting wheel's 10 rotation. Once again, it is the first ramp 20 and first plunger 55 which cause the movement of the backstop 60. Since the desired object of the present invention is to insure a three millimeter contact gap when the thermostat is off, first ramp 20 must be positioned on the setting wheel so that when the thermostat is turned off, the backstop 60 is moved to the desired three millimeter distance from the fixed contact 65. Further, the second ramp 15 in this embodiment must be arranged so that when the thermostat is set to an off position, the mass 80 of the movable contact 70 will not be in contact with the fixed contact 65. In this embodiment, this requires that the highest part 18 of second ramp 15 be approximately 180 degrees around the circumference of the setting wheel 10. However, the positioning of the first ramp with respect to the height of the second ramp will vary depending upon, among other things, the placement of the first and second levers 45, 25.

Figure 3:
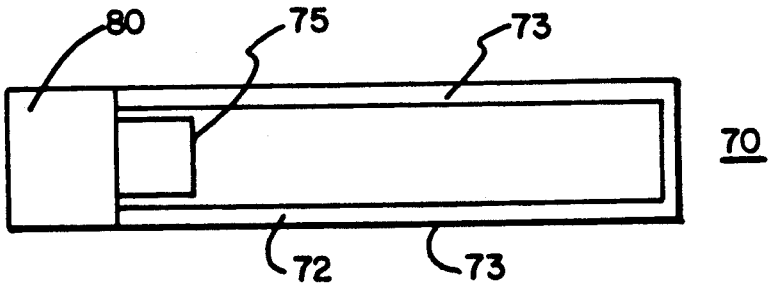
FIG. 3 is a top view of the movable contact.

Referring now to FIG. 3, the movable contact 70 in this embodiment operates as a snap action mechanism. The movable contact 70 comprises a blade 72, and a mass 80. To make the blade operate as a snap action mechanism, blade 72 is comprised of tension member 75 and first and second rails 73. Tension member 75 is deformed as shown in FIG. 1 by tension flange 85. When second plunger 40 exerts pressure on blade 72, tension on tension member 75 is increased, while the mass is moved away from the fixed contact 65. When the second plunger 40 is moved away from the blade far enough, the tension member 75 will seek a rest position, thus snapping back so that the mass is in contact with the fixed contact.

The foregoing has been a description of a novel and non-obvious thermostat having a movable backstop. Nothing in the foregoing description is intended to limit the scope of the property rights claimed by the inventors, but instead the inventors claim as their property the invention defined by the claims appended hereto.

We claim:

1. A thermostat, comprising:

a setting wheel rotatably attached to said frame having an outer edge and a central region, a first ramp formed on said outer edge and a second ramp formed on said central region;

a first lever having first and second ends, said first end of said first lever being attached to said frame, and said second end of said first lever being arranged to contact said first ramp;

a first plunger having first and second ends and a longitudinal axis, said first plunger being movable along said longitudinal axis, said first end of said plunger being in contact with said first lever;

a backstop slidably attached to said frame movable in the axial direction of said first plunger, said backstop being in contact with said second end of said first plunger and being adapted to move when said setting wheel is positioned such that said first ramp contacts and caused said first lever to move which in turn causes said first plunger to move in said axial direction;

a second lever having a first and ends, said first end of said second lever being attached to said frame, said second end of said second lever movable between first and second positions, said second end of said lever further being in contact with said second ramp;

a second plunger having first and second ends in a longitudinal axis, said second plunger being movable along its longitudinal axis between third and fourth positions;

a deformable element interposed between said first end of said second plunger and said second lever, said deformation occuring as a function of temperature;

a movable contact having an elongated shape and first and second ends, said first end of said movable contact being attached to said frame, said second end of said movable contact movable between fifth and sixth positions by said second plunger; and a fixed contact attached to said frame adapted to be contacted by said movable contact.

2. The thermostat of claim 1, wherein;

said movable contact has first and second major surfaces, said first major surface being formed with a metallic mass thereon.

3. The thermostat of claim 1, wherein:

said first extreme position is three millimeters away from said fixed contract, said second extreme position being less then three millimeters from said fixed contact.

4. The thermostat of claim 3, wherein said backstop means is comprised of:

first and second flanges, said first and second flanges being physically attached to each other substantially perpendicularly, said second flange having a major surface adjacent said movable contacts;

a plunger having first and second ends and a central axis, said first end being in contact with said second flange and said second end being positioned so that said first lever when travelling between said first and second positions makes contact therewith, said plunger being journaled in an opening in said frame so that said plunger may only move along its central axis; and a compressible spring interposed between said backstop and said frame and being adapted to move said backstop from said second to said first extreme position.

5. A thermostat, comprising:

a frame;

a setting wheel rotatably attached to said frame having an outer edge and a central region, said setting wheel having a first ramp formed on said outer edge and a second ramp formed in said central region;

a first lever having first and second ends and movable between first and second positions pivotally attached to said frame at said first end of said first lever, said first lever being in contact with said ramp at said second end of said first lever and being adapted to move between said first and second positions upon rotation of said setting wheel;

a deformable element connected to said second lever, said deformable element expanding and contracting has a function of temperature;

a fixed contact attached to said frame adapted to connect to an electrical circuit;

a movable contact in contact with said second lever, said movable contact being movable in response to rotation of said setting wheel, and being adapted to physically contact said fixed contact when a preselected criteria has been achieved;

a backstop means movable between first and second extreme positions, said backstop means being physically in contact with said first lever, said first lever when moved from said first to said second position causing said backstop means to move from said first two a second of said extreme positions, said backstop means further being positioned so that said movable contact lies between said backstop means and said fixed contact;

second lever having first and second ends and movable between first and second positions pivotally attached to said frame at said first end of said second lever, said second end of said second lever being in contact with said second ramp and adapted to move said movable contact between said fixed contact and said backstop.

6. An improved thermostat of the type including a frame, a setting wheel, a movable contact, a fixed contact, and a backstop, said movable contact being positioned so that it can move between said fixed contact and said backstop in response to rotation of said setting wheel, wherein the improvement comprises a means for moving the backstop between two extreme positions, said means for moving being comprised of:

a ramp positioned on said setting wheel;

a lever having first and second ends, said first end being attached to said frame, said second end being adapted to contact said ramp, said second end being movable pivotally between first and second positions;

a plunger having first and second ends, said second end being in contact with said backstop, said first end being in contact with said lever, said plunger being able to move said backstop form one of said extreme positions to the other, when said lever moves from said first to said second position; and a spring having first and second ends, said first end being attached to said frame, said second end being attached to said backstop, said spring being adapted to cause said backstop to be at the position of two extreme positions which is nearer to said fixed contact.

* * * * *

UNITED STATES PATENT AND TRADEMARK OFFICE

CERTIFICATE OF CORRECTION

PATENT NO. : 5,006,827

DATED : April 9, 1991

INVENTOR(S) : STEPHEN J. BRUETON, ADRIANA V. SERBANESCU

It is certified that error appears in the above-identified patent and that said Letters Patent is hereby corrected as shown below:

Title page, item [73]:
Assignee, cancel "Honeywell, Inc." and substitute
--Honeywell Limited--.

Column 4, line 39, cancel "a first and" and substitute
--first and second--;
line 66, cancel "contract" and substitute --contact--.

Column 6, line 6, cancel "two" and substitute --to--.

Signed and Sealed this

Sixth Day of October, 1992

*Attest:*

DOUGLAS B. COMER

*Attesting Officer*

*Acting Commissioner of Patents and Trademarks*